US009432787B2

(12) United States Patent
Krishnaswamy et al.

(10) Patent No.: US 9,432,787 B2
(45) Date of Patent: Aug. 30, 2016

(54) SYSTEMS AND METHODS FOR DETERMINING THE CONDITION OF MULTIPLE MICROPHONES

(71) Applicant: Apple Inc., Cupertino, CA (US)

(72) Inventors: Arvindh Krishnaswamy, San Jose, CA (US); David T. Yeh, San Jose, CA (US); Juha O. Merimaa, Redwood City, CA (US); Sean A. Ramprashad, Los Altos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/019,521

(22) Filed: Feb. 9, 2016

(65) Prior Publication Data

US 2016/0219386 A1 Jul. 28, 2016

Related U.S. Application Data

(62) Division of application No. 13/790,380, filed on Mar. 8, 2013, now Pat. No. 9,301,073.

(60) Provisional application No. 61/679,619, filed on Aug. 3, 2012, provisional application No. 61/657,265, filed on Jun. 8, 2012.

(51) Int. Cl.
*H04R 29/00* (2006.01)
*H04R 3/00* (2006.01)

(52) U.S. Cl.
CPC ..... *H04R 29/005* (2013.01); *H04R 3/00* (2013.01); *H04R 2499/11* (2013.01)

(58) Field of Classification Search
None
See application file for complete search history.

(56) References Cited

U.S. PATENT DOCUMENTS

| | | | | |
|---|---|---|---|---|
| 2008/0095384 | A1* | 4/2008 | Son | G10L 25/87 381/94.1 |
| 2009/0196429 | A1 | 8/2009 | Ramakrishnan et al. | |
| 2009/0296946 | A1 | 12/2009 | Zhang | |
| 2010/0027809 | A1 | 2/2010 | Liu et al. | |
| 2010/0081487 | A1 | 4/2010 | Chen et al. | |
| 2012/0245932 | A1* | 9/2012 | Ouchi | G01S 3/80 704/231 |
| 2012/0316869 | A1* | 12/2012 | Xiang | H04K 1/02 704/226 |
| 2013/0155816 | A1 | 6/2013 | Li et al. | |

* cited by examiner

*Primary Examiner* — Paul Huber
(74) *Attorney, Agent, or Firm* — Blakely, Sokoloff, Taylor & Zafman LLP

(57) ABSTRACT

Systems and methods for determining the operating condition of multiple microphones of an electronic device are disclosed. A system can include a plurality of microphones operative to receive signals, a microphone condition detector, and a plurality of microphone condition determination sources. The microphone condition detector can determine a condition for each of the plurality of microphones by using the received signals and accessing at least one microphone condition determination source.

18 Claims, 5 Drawing Sheets

SYSTEMS AND METHODS FOR DETERMINING THE CONDITION OF MULTIPLE MICROPHONES

CROSS-REFERENCE TO RELATED PROVISIONAL APPLICATIONS

This application is a divisional of co-pending U.S. application Ser. No. 13/790,380 filed on Mar. 8, 2013, which claims the benefit of U.S. Provisional Patent Application Nos. 61/657,265 and 61/679,619 filed on Jun. 8, 2012 and Aug. 3, 2012, respectively, the disclosures of which are hereby incorporated herein by reference in their entireties.

FIELD OF THE INVENTION

The disclosed embodiments relate generally to electronic devices, and more particularly, to electronic devices having multiple microphones.

BACKGROUND OF THE INVENTION

Many electronic devices are equipped with one or more microphones to receive and process sounds. For example, telephones have a microphone for receiving and processing speech. Devices equipped with multiple microphones may employ applications that can utilize signals being received by one or more of the microphones. If one or more of the microphones are subjected to various factors that affect the signals being captured, they may not be reliable or useful for the application. Accordingly, what is needed is the capability to detect the condition of the microphones.

SUMMARY OF THE DISCLOSURE

Generally speaking, it is an object of the present invention to provide systems and methods for determining the condition of multiple microphones.

In some embodiments, a method for determining the operating conditions of microphones of an electronic device can be provided. The method can include receiving signals from a plurality of microphones, providing at least one microphone condition determination source, providing the signals to a microphone condition detector, and accessing, using the microphone condition detector, at least one of the at least one microphone condition determination source in conjunction with the signals to determine an operating condition for each of the plurality of microphones.

In some embodiments, a method for determining the operating condition of microphones of an electronic device can also be provided. The method can include receiving signals from a plurality of microphones, receiving device centric data, and setting a threshold for each of the plurality of microphones based on the device centric data. The method can also include identifying as a different signal a received signal that differs from the other of the received signals, determining a difference factor between the different signal and the other of the received signals, and ceasing to use the different signal when the difference factor exceeds the threshold for a microphone of the plurality of microphones that is a source of the different signal.

In some embodiments, a system can include a plurality of microphones in an electronic device configured to receive signals. The system can also include a microphone condition detector and at least one microphone condition determination source. The microphone condition detector can be configured to access at least one of the at least one microphone condition determination source in conjunction with the received signals to determine an operating condition for each of the plurality of microphones.

In some embodiments, an electronic device can include a plurality of microphones, at least one microphone condition determination source, and a microphone condition detector. The microphone condition detector can be configured to receive signals transmitted from the microphones, access at least one of the at least one microphone determination source, and in conjunction with the received signals, determine an operating condition for each of the plurality of microphones.

BRIEF DESCRIPTION OF THE DRAWINGS

The above and other aspects and advantages of the invention will become more apparent upon consideration of the following detailed description, taken in conjunction with the accompanying drawings, in which like reference characters refer to like parts throughout, and in which.

DETAILED DESCRIPTION OF THE PREFERRED EMBODIMENTS

Systems and methods for determining the condition of multiple microphones are disclosed.

Figure 1A:
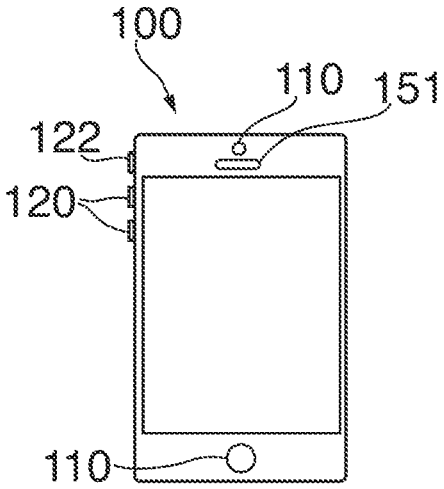
FIGS. 1A-IC show illustrative top, bottom, and side views, respectively, of an electronic device in accordance with an embodiment.

FIGS. 1A-IC show illustrative top, bottom, and side views, respectively, of an electronic device 100 in accordance with an embodiment. Electronic device 100 may generally be any suitable electronic device capable of having two or more microphones integrated therein. A more detailed discussion of electronic device 100 can, for example, be found in the description accompanying FIG. 5, below.

Electronic device 100 can include, among other components, microphones 110, 111, and 112, buttons 120, a switch 122, a connector 130, a speaker 140, and a receiver 150. Microphones 110-112 can be any suitable sound processing device such as, for example, a MEMS microphone. The location of microphones 110-112 may be in discrete and known locations. As shown, microphone 110 can be located on the front face of device 100, microphone 111 can be located on the back face of device 100, and microphone 112 can be located on a side of device 100. In particular, microphone 112 can be located on the bottom side of device 100. In geometric terms, microphones 110 and 111 can be on substantially parallel planes with respect to each other and microphone 112 can be on a plane substantially perpendicular thereto. It is to be understood that device 100 can include any suitable number of microphones exceeding two or three in number, and that the microphones can be positioned anywhere on the device. In some embodiments, in order to better determine microphone conditions, at least three microphones, each located in different planes, are included.

Figure 2:
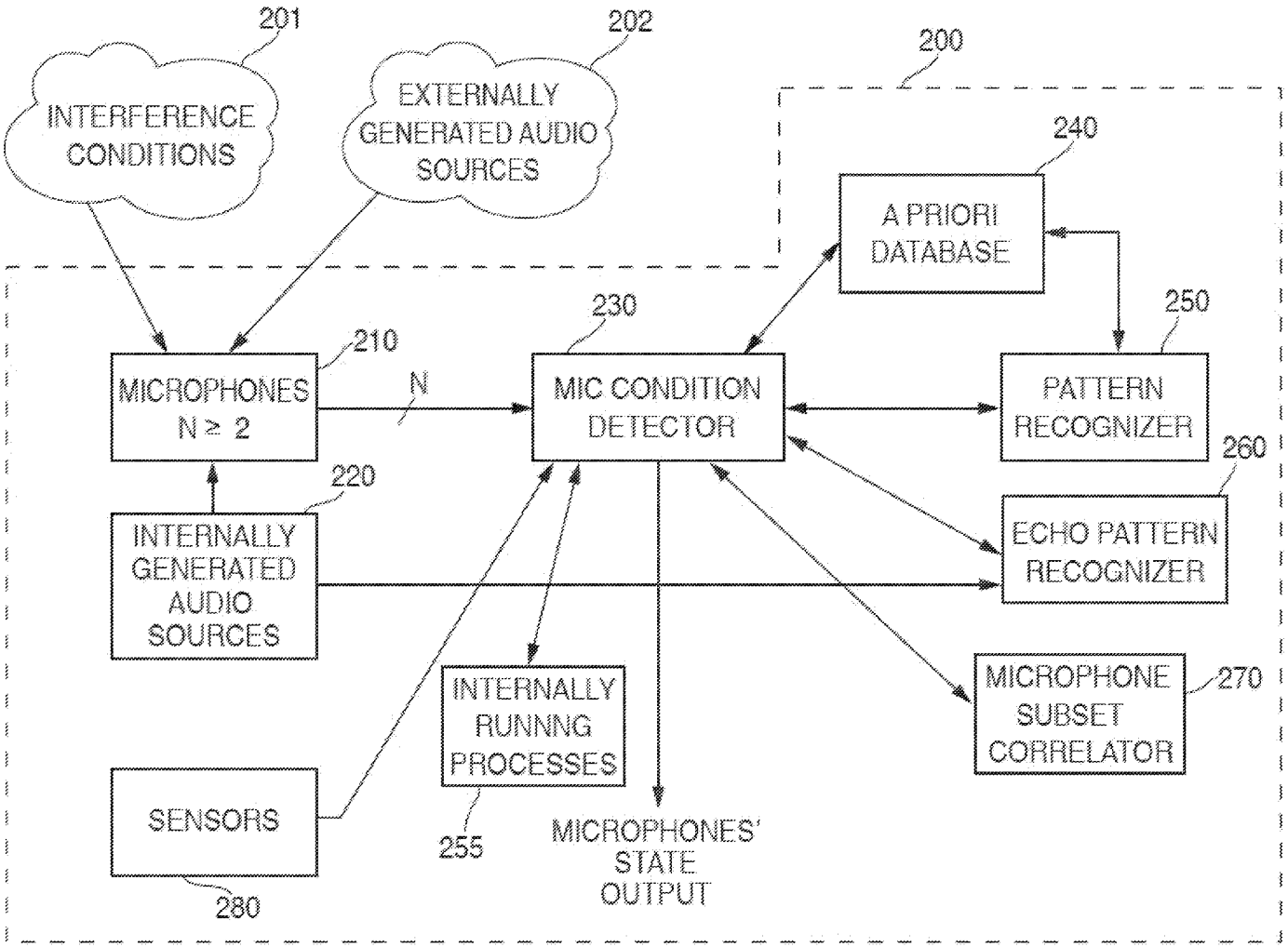
FIG. 2 is an illustrative schematic diagram of an electronic device including several software and hardware components in accordance with an embodiment.

Referring now to FIG. 2, an illustrative schematic diagram showing an electronic device 200 having several software and hardware components in accordance with an embodiment is shown. Also shown in FIG. 2 are generic representations of interference conditions 201 and externally generated audio sources 202, both of which may represent factors external to device 200 that are imposed on device 200. Electronic device 200 can include a mixture of hardware and software components that enable device 200 to determine the condition of microphones 210. As shown, device 200 can include microphones 210, internally generated audio sources 220, a microphone conditional state detector 230, an a priori database 240, a pattern recognizer 250, an echo pattern recognizer 260, a microphone subset correlator 270, and sensors 280.

Figure 1B:
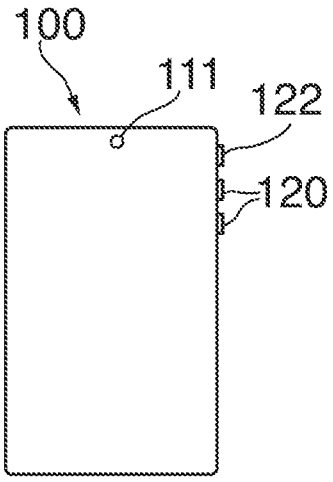
Figure 1C:
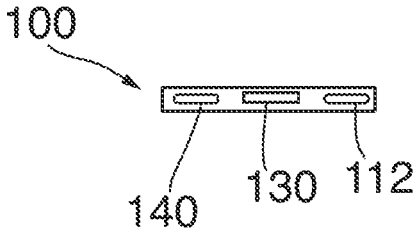

Microphones 210 may represent two or more microphones. For example, microphones 210 can represent the same three microphones shown in FIGS. 1A-1C. Microphones 210 can receive signals from externally generated audio sources 202 (e.g., a person's voice) and can be subject to imposed interference conditions 201 (e.g., an occluded microphone or windy conditions). In addition, microphones 210 can receive internally generated audio sources 220 such as, for example, sounds produced by a loud speaker, a vibration motor, or a combination thereof. Upon receiving inputs from one or more of interference conditions 201 and audio sources 202 and 220, microphones 210 can provide signals to one or more hardware or software components of device. However, for ease of discussion, and in the sake of the clarity of FIG. 2, these signals are shown as being provided to microphone condition detector 230.

The condition of microphones 210 can be ascertained using microphone condition detector 230. Detector 230 can process many different sources of information (e.g., signals provided by microphones 210, a priori database 240, pattern recognizer 250, echo pattern recognizer 250, echo pattern recognizer 260, microphone subset correlator 270, and sensors 280) to determine the condition of each microphone in device 200. The different sources of information are discussed in more detail below.

Turning now the discussion turns to the different types of conditions to which the microphones may be subjected, these conditions can be segregated into two general categories: free-field and interference. The free-field condition occurs when all of the microphones are operating in a "NORMAL" state, and is considered to be an ideal use case condition. A device operating in a free-field condition can pick up and process audio signals without any interference, and any audio processing algorithms using the signals received by the microphones will not be confused. Interference conditions occur when one or more of the microphones are affected and are not able to function in a free-field state. When an interference condition is imposed on one or more of the microphones, the device is no longer operating in the free-field condition and the microphone condition detector informs the audio processing algorithms as such so that they can function appropriately.

Examples of interference conditions can include occlusion, environmental factors, and microphone failure. The condition of occlusion can occur when an object blocks the pathway to the microphone, thereby preventing the microphone from capturing a reliable signal. The object can be, for example, a person's hand, finger, or other body part, debris such as dirt, particulate matter, water, or a surface such as a table.

Environmental factors can include windy conditions and extreme background noise. Another example of an environmental condition can occur when a microphone is occluded by a relatively solid object (such as a table) through which noises (e.g., scratching, pounding, tapping, or knocking) can reverberate and can be picked up by the microphone.

The failure condition can occur when the microphone fails to function properly, resulting in inaccurate signals, or fails to function at all, resulting in a dead signal. A microphone can generate its own noise that may disrupt or affect the signal processed by that microphone.

Any one or a combination of the interference conditions can affect one or more microphones and their ability to process signals, and a microphone condition detector can determine whether any of the microphones are being subjected to an interference condition.

Microphone condition detector 230 can draw on a multitude of sources to make intelligent decisions as to whether any of the microphones are subjected to any of the interference conditions, and to distinguish among the different conditions. These sources can be generically referred to as microphone condition determination sources. The sources can include a priori information database 240, pattern recognizer 250, internally running processes 255, echo pattern recognizer 260, microphone subset correlator 270, and sensors 280. It will be appreciated that access to all of these sources enables detector 230 to distinguish among the different conditions in a robust and reliable manner to determine the state of each microphone.

A priori information database 240 can include already known data points and information about the microphones, as well as other information that is known or can serve as a reference. The absolute location of each microphone within the device and the relative locations with respect to each other are examples of a priori information. Information germane to "NORMAL" operating microphones such as self-generated noise is an example of a priori information. A priori information can include all measurable characteristics of a microphone or combination of microphones subjected to different controlled interference conditions. For example, the signal response of an occluded microphone can be stored in a database. In addition, the signal responses for a microphone occluded with many different types of objects can be stored in the database.

Pattern recognizer 250 can recognize patterns in the signals received by microphones 210. These patterns can be used in real-time to build a database of known patterns, or the patterns can be compared to patterns already stored in a database (e.g., database 240).

Microphone condition detector 230 can use information obtained from internally running processes 255 or internally generated and known signals. In one embodiment, outputs and internal variables of various running algorithms can provide clues as to the state of the microphones. For example, algorithms that are calculating noise estimates, spectral tilts, centroids, or shapes of the signals received from each of the microphones can be used to determine the condition of each individual microphone.

Echo pattern recognizer 260 can provide detector 230 additional cues when a loudspeaker (e.g., an audio source in internally generated audio sources 220) is being used. Echo pattern recognizer 260 can analyze echo patterns to provide additional clues as to the state of each microphone. In this embodiment, microphone condition detector 230 may receive data from echo cancellation circuitry (not shown), noise suppression circuitry (not shown), the signal(s) being provided to the loudspeaker, and signals from each of the microphones.

Microphone subset correlator 270 can perform a cross-comparison of subsets of all the microphones. The cross-comparison provides additional cues to the detector 230 to determine which, if any, of the microphones are being subjected to an interference condition. Assuming there are only three microphones in a device—MICS1-3, the subset cross-comparison can include a comparison of MIC1 to MIC2; MIC1 to MIC3; MIC2 to MIC3; MIC1 to (MICS2-3); MIC2 to (MIC1 and MIC3); and MIC3 to (MICS1-2). It is to be understood that if there are additional microphones such as four microphones on the device, then a more elaborate set of subsets can be compared, any number of which can be compared to assist microphone condition detector 230 in determining the state of each microphone.

Coupling the cross-comparison of microphone subsets with their known absolute placement, and their relative placement to each other may can be used by microphone condition detector 230 to determine the condition of each microphone. Because each microphone is located in a different location on the device, each microphone may process the same external sound differently depending on whether it is subjected to an interference condition. For example, if one microphone is occluded, its signal will be different than the other microphones receiving the same external sound. When the microphone condition detector cross-correlates the signals, it can determine that the signal corresponding to the occluded microphone is significantly different than the signal received by the other microphones. Based on this comparison, the condition detector may decide that the occluded microphone is not accurately receiving and processing the external sound and is operating in a "COMPROMISED" state, and that the other microphones are operating in a "NORMAL" state.

As another example, if the device has two microphones that can be relatively easily occluded, and a third one that is not easily occluded, a cross-comparison of all the microphones can result in a robust idea of the system state. Even if the third microphone is not needed for processing algorithms, it can be used as a guide for determining the state of each microphone.

The condition or state of the microphones can be determined by having microphone condition detector 230 use any one or a combination of database 240, pattern recognizer 250, internally running processes 255, echo pattern recognizer 260, subset correlator 270, and sensors 280 in conjunction with signals provided by microphones 210. In one embodiment, detector 230 can use subset correlator 270 in conjunction with database 240 to determine the state of each microphone. In another embodiment, detector 230 can use subset correlator 270 and pattern recognizer 250 to determine the state of each microphone. In yet another embodiment, detector 230 can use database 240 and pattern recognizer 250 to determine the state of each microphone.

Sensors 280 can include any suitable number of sensors that are included within device 200. Data obtained by sensors 280 can be provided to microphone condition detector 230. Data obtained by sensors 280 is referred to herein as device centric data. Sensors 280 can include one or more of the following: a proximity sensor, an accelerometer, a gyroscope, and an ambient light sensor. Accelerometer and gyroscope sensors can provide orientation information of the device. For example, if the device is placed on a table, one or more of these sensors can determine which side of the device is face down on the table. The proximity sensor may indicate whether an object is within close proximity of the device. For example, if the device is placed near a user's cheek, the proximity sensor can detect the cheek. The ambient light sensor can provide data relating to ambient light conditions near the device.

Microphone condition detector 230 can use data supplied by sensors 280 to determine the condition of the microphones. Detector 230 can correlate data received from sensors 280 with data received from other sources (e.g., microphones 210, a priori database 240, or pattern recognizer 260). For example, microphone condition detector 230 can analyze power signal(s) received on each microphone 210, and may conclude that one of the microphones may possibly be occluded. To verify whether that microphone is actually occluded, detector 230 can use data (e.g., orientation data) from sensors 280 to verify that that microphone is occluded. For example, if the device is face down on the table, the microphone abutting the table would be occluded, and the orientation information could verify this.

Microphone condition detector 230, after determining the condition of each microphone, can provide state information (indicative of each microphone's condition) to another software or hardware block that may require or that may benefit from the state information. For example, the state information can be provided to an audio processing algorithm for a particular application. The audio processing algorithm can use the state information, and thus can know how to process signals received from the microphones. Continuing with the example, if the state information indicates one of the microphones is occluded, but the other two microphones are operating in the free-field state, the algorithm may choose to ignore the signal of the occluded microphone.

Figure 3:
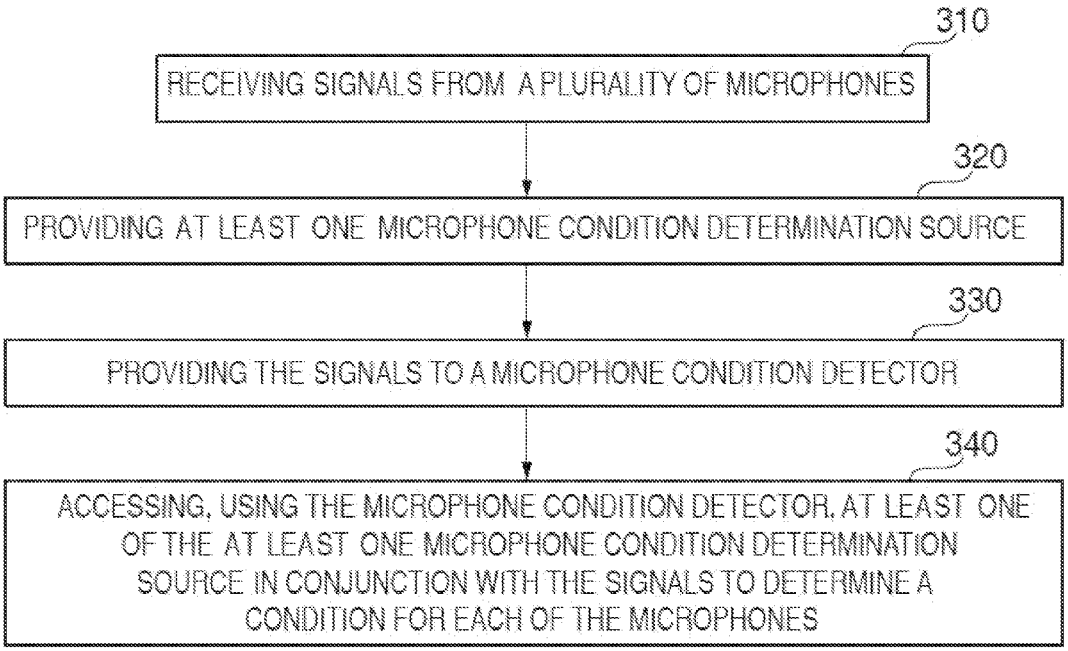
FIG. 3 is a flowchart of an illustrative process for determining the condition of multiple microphones in accordance with an embodiment.

Turning now to FIG. 3, a flowchart of an exemplary process for determining the condition of multiple microphones is shown. This process can be executed by one or more components of an electronic device (e.g., device 100 of FIG. 1 or device 200 of FIG. 2). Beginning at step 310, the process can include receiving signals from a plurality of microphones. For example, microphones 110-112 may each produce a signal in response to audio sources picked up by the microphones. At step 320, the process can include providing at least one microphone condition determination source. For example, the priori database, the pattern recognizer, the internally running processes, the echo pattern recognizer, or the microphone subset correlator can be accessed.

At step 330, the process can include providing the signals to a microphone condition detector. For example, the received signals can be provided to microphone condition detector 230. At step 340, process can include accessing, using the microphone condition detector, at least one of the at least one microphone condition determination source in conjunction with the signals to determine an operating condition for each of the plurality of microphones. For example, microphone condition detector 230 can use any one or a combination of the plurality of microphone condition determination sources (e.g., a priori information database 240, pattern recognizer 250, internally running processes 255, echo pattern recognizer 260, microphone subset correlator 270, and sensors 280) in conjunction with the received signals to determine a condition for each of microphones 210.

It should be understood that the process of FIG. 3 is merely illustrative. Any of the steps may be removed, modified, or combined, and any additional steps may be added, without departing from the scope of the invention.

Figure 4:
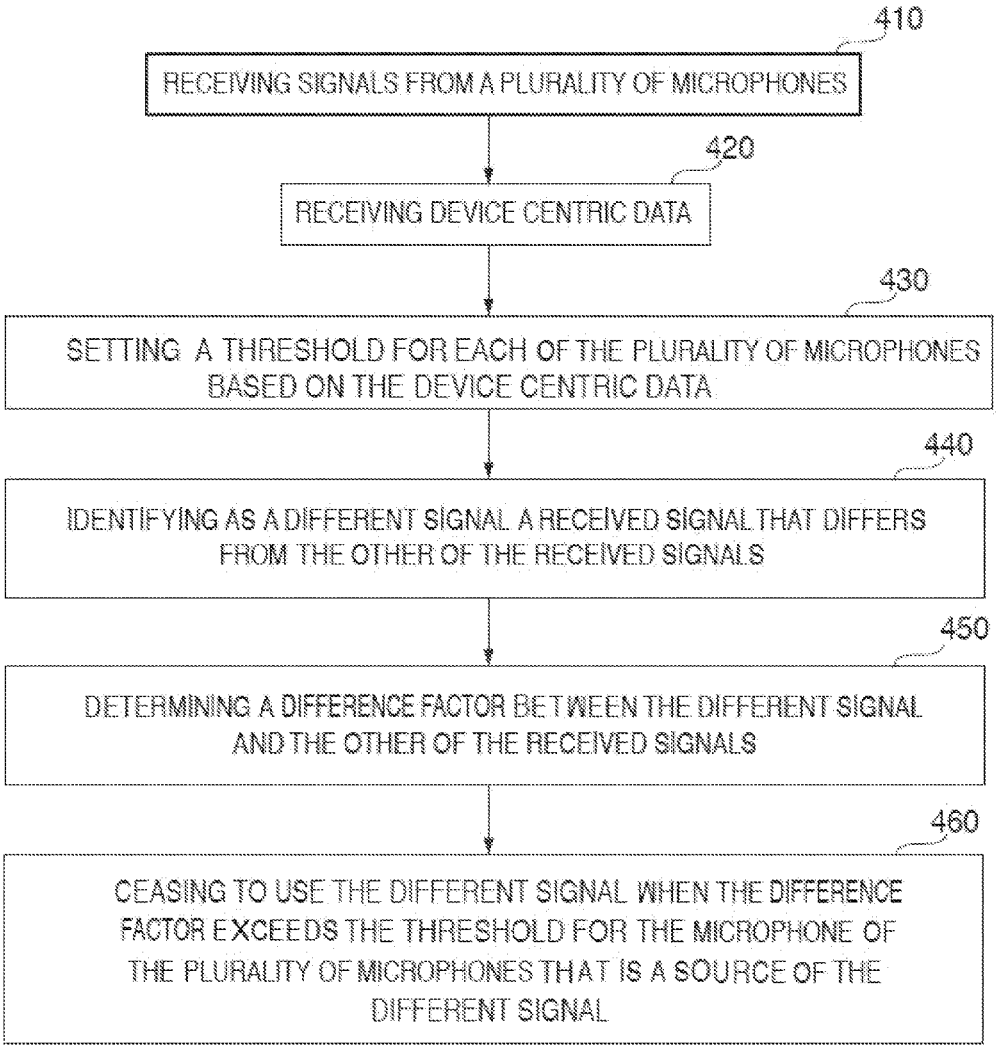
FIG. 4 is a flowchart of another illustrative process for determining the condition of multiple microphones in accordance with an embodiment.

FIG. 4 is a flowchart of another illustrative process for determining the condition of multiple microphones in accordance with an embodiment. This process takes into account device centric data obtained from one or more sensors (e.g., sensors 280) within the device. Since the device may be handled by a user in any number of different ways, some of which may result in interference with a microphone's ability to process received sounds in a free-field manner, the device centric data can provide hints, which can be tempered by adjustable thresholds, to better enable the microphone condition detector to determine whether one or more of the microphones are affected by an external source. If the microphone condition detector determines that one of the microphones is producing a signal dissimilar to the other microphones, the detector can correlate that microphone with the device centric data to determine whether it is being handled or positioned in a manner that it more likely than not causing occlusion. For example, if the device is laying on a table, then the microphone facing the table may produce a sound that is substantially different than the other microphones. The microphone condition detector can detect this difference and verify that this microphone should produce a different signal based on the device centric data.

The physical handling of a device is not necessarily always discrete (e.g., such as being placed on a table) but is often non-discrete because it is jostled about or has objects (e.g., hand, cheek, or fingers) placed in the vicinity of a microphone that may at least partially occlude the microphone. To account for such non-discrete circumstances, signal thresholds of varying degrees can be assigned to each microphone based on the device centric data. The thresholds can change when the device is moved or an object is placed near the device, and the device centric data indicates such a change in condition(s).

Beginning at step 410, the process can include receiving signals from a plurality of microphones. For example, a device can have two or more microphones (e.g., microphones 210), each of which can be operative to receive and process sounds. The received signals can be provided to a microphone condition detector (e.g., microphone condition detector 230) in accordance with an embodiment. At step 420, the process can include receiving device centric data. As described above, device centric data is any data generated internally by the device itself and can include orientation, environmental, or object proximity data. This data may also be provided to the microphone condition detector.

At step 430, the process can include setting a threshold for each of the plurality of microphones based on the device centric data. For example, the thresholds can be set to indicate a probability of occlusion for a particular microphone.

At step 440, the process can include identifying as a different signal a received signal that differs from the other of the received signals. For example, the process can include identifying that one of the signals of one of the microphones is different from the other signals of the other microphones. At step 450, the process can include determining a difference factor between the different signal and the other of the received signals. For example, the process can include determining a difference factor between the one of the signals of one of the microphones and the other signals of the other microphones. The condition detector can infer, from this determined difference factor, that the different signal is attributable to an occluded microphone. The difference in the signals represented by the difference factor can be normalized for use in connection with the thresholds set for each microphone.

At step 460, the process can include ceasing to use the different signal when the difference factor exceeds the threshold for a microphone of the plurality of microphones that is a source of the different signal. In this step, the microphone condition detector can correlate the different signal to the received device centric data to determine whether it should use the different signal. For example, when the difference factor exceeds the threshold, then the different signal may no longer be used. As another example, when the difference factor does not exceed the threshold, then the different signal can be used.

It should be understood that the process of FIG. 4 is merely illustrative. Any of the steps may be removed, modified, or combined, and any additional steps may be added, without departing from the scope of the invention. For example, the comparison of the difference factor and threshold can be reversed; that is, the different signal can be used if it exceeds the threshold.

Figure 5:
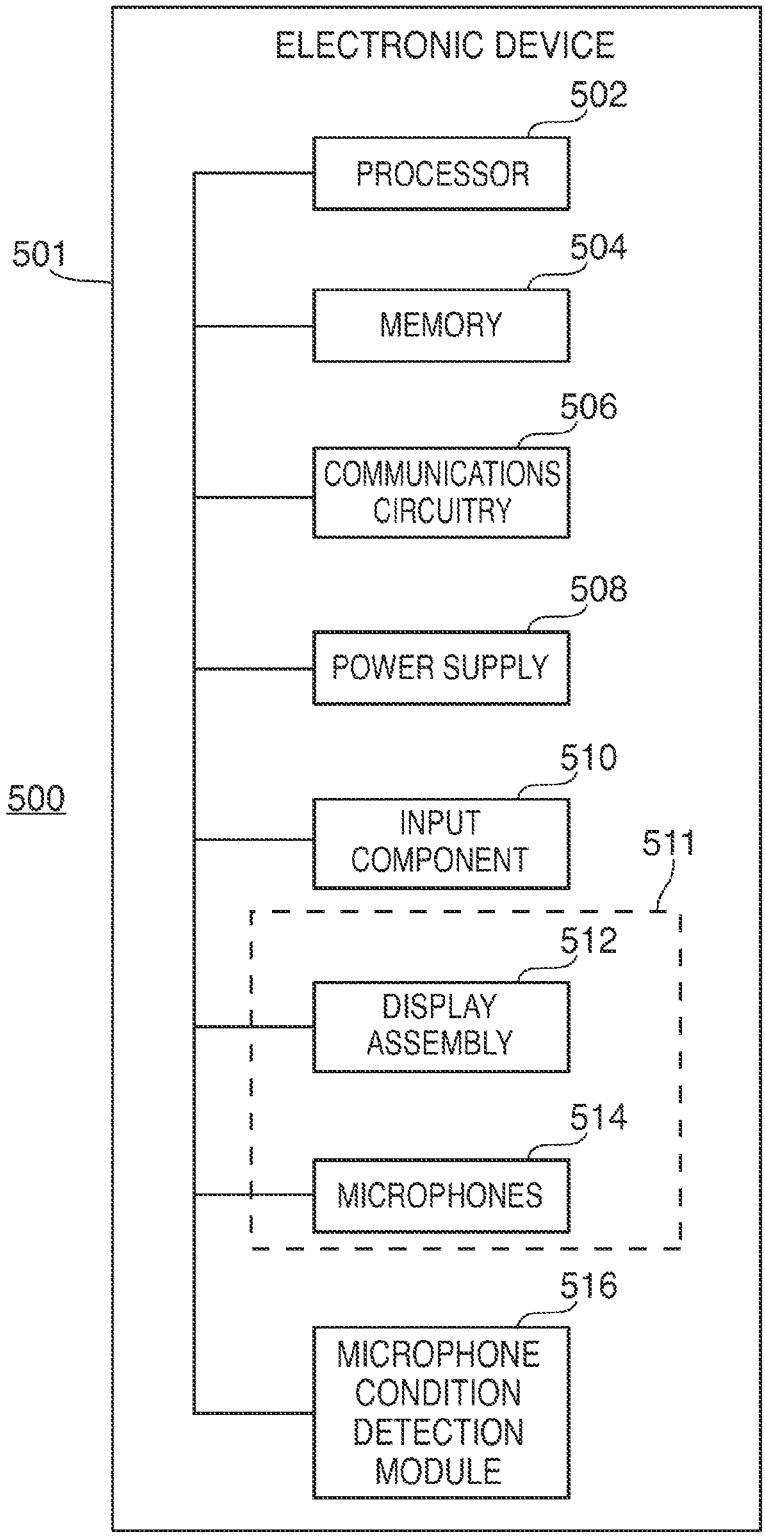
FIG. 5 is a schematic illustration of an electronic device in accordance with an embodiment.

FIG. 5 is a schematic view of an illustrative electronic device in accordance with an embodiment. Electronic device 500 may correspond to or be the same as any one of devices 100 and 200. Electronic device 500 may be any portable, mobile, or hand-held electronic device configured to present visible information on a display assembly wherever the user travels. Alternatively, electronic device 500 may not be portable at all, but may instead be generally stationary. Electronic device 500 can include, but is not limited to, a music player, video player, still image player, game player, other media player, music recorder, movie or video camera or recorder, still camera, other media recorder, radio, medical equipment, domestic appliance, transportation vehicle instrument, musical instrument, calculator, cellular telephone, other wireless communication device, personal digital assistant, remote control, pager, computer (e.g., desktop, laptop, tablet, server, etc.), monitor, television, stereo equipment, set up box, set-top box, boom box, modem, router, keyboard, mouse, speaker, printer, and combinations thereof. In some embodiments, electronic device 500 may perform a single function (e.g., a device dedicated to displaying image content) and, in other embodiments, electronic device 500 may perform multiple functions (e.g., a device that displays image content, plays music, and receives and transmits telephone calls).

Electronic device 500 may include a housing 501, a processor or control circuitry 502, memory 504, communications circuitry 506, power supply 508, input component 510, display assembly 512, microphones 514, and microphone condition detection module 516. Electronic device 500 may also include a bus 503 that may provide a data transfer path for transferring data and/or power, to, from, or between various other components of device 500. In some embodiments, one or more components of electronic device 500 may be combined or omitted. Moreover, electronic device 500 may include other components not combined or included in FIG. 5. For the sake of simplicity, only one of each of the components is shown in FIG. 5.

Memory 504 may include one or more storage mediums, including for example, a hard-drive, flash memory, permanent memory such as read-only memory ("ROM"), semi-permanent memory such as random access memory ("RAM"), any other suitable type of storage component, or any combination thereof. Memory 504 may include cache memory, which may be one or more different types of memory used for temporarily storing data for electronic device applications. Memory 504 may store media data (e.g., music, image, and video files), software (e.g., for implementing functions on device 500), firmware, preference information (e.g., media playback preferences), lifestyle information (e.g., food preferences), exercise information (e.g., information obtained by exercise monitoring equipment), transaction information (e.g., information such as credit card information), wireless connection information (e.g., information that may enable device 500 to establish a wireless connection), subscription information (e.g., information that keeps track of podcasts or television shows or other media a user subscribes to), contact information (e.g., telephone numbers and e-mail addresses), calendar information, any other suitable data, or any combination thereof.

Communications circuitry 506 may be provided to allow device 500 to communicate with one or more other electronic devices or servers using any suitable communications protocol. For example, communications circuitry 506 may support Wi-Fi™ (e.g., an 802.11 protocol), Ethernet, Bluetooth™, high frequency systems (e.g., 900 MHz, 2.4 GHz, and 5.6 GHz communication systems), infrared, transmission control protocol/internet protocol ("TCP/IP") (e.g., any of the protocols used in each of the TCP/IP layers), hypertext transfer protocol ("HTTP"), BitTorrent™, file transfer protocol ("FTP"), real-time transport protocol ("RTP"), real-time streaming protocol ("RTSP"), secure shell protocol ("SSH"), any other communications protocol, or any combination thereof. Communications circuitry 506 may also include circuitry that can enable device 500 to be electrically coupled to another device (e.g., a computer or an accessory device) and communicate with that other device, either wirelessly or via a wired connection.

Power supply 508 may provide power to one or more of the components of device 500. In some embodiments, power supply 508 can be coupled to a power grid (e.g., when device 500 is not a portable device, such as a desktop computer). In some embodiments, power supply 508 can include one or more batteries for providing power (e.g., when device 500 is a portable device, such as a cellular telephone). As another example, power supply 508 can be configured to generate power from a natural source (e.g., solar power using one or more solar cells).

One or more input components 510 may be provided to permit a user to interact or interface with device 500. For example, input component 510 can take a variety of forms, including, but not limited to, a track pad, dial, click wheel, scroll wheel, touch screen, one or more buttons (e.g., a keyboard), mouse, joy stick, track ball, and combinations thereof. For example, input component 510 may include a multi-touch screen. Each input component 510 can be configured to provide one or more dedicated control functions for making selections or issuing commands associated with operating device 500.

Electronic device 500 may also include one or more output components that may present information (e.g., textual, graphical, audible, and/or tactile information) to a user of device 500. An output component of electronic device 500 may take various forms, including, but not limited, to audio speakers, headphones, audio line-outs, visual displays, antennas, infrared ports, rumblers, vibrators, or combinations thereof.

For example, electronic device 500 may include display assembly 512 as an output component. Display 512 may include any suitable type of display or interface for presenting visible information to a user of device 500. In some embodiments, display 512 may include a display embedded in device 500 or coupled to device 500 (e.g., a removable display). Display 512 may include, for example, a liquid crystal display ("LCD"), a light emitting diode ("LED") display, an organic light-emitting diode ("OLED") display, a surface-conduction electron-emitter display ("SED"), a carbon nanotube display, a nanocrystal display, any other suitable type of display, or combination thereof. Alternatively, display 512 can include a movable display or a projecting system for providing a display of content on a surface remote from electronic device 500, such as, for example, a video projector, a head-up display, or a three-dimensional (e.g., holographic) display. As another example, display 512 may include a digital or mechanical viewfinder. In some embodiments, display 512 may include a viewfinder of the type found in compact digital cameras, reflex cameras, or any other suitable still or video camera.

It should be noted that one or more input components and one or more output components may sometimes be referred to collectively as an I/O interface (e.g., input component 510 and display 512 as I/O interface 511). It should also be noted that input component 510 and display 512 may sometimes be a single I/O component, such as a touch screen that may receive input information through a user's touch of a display screen and that may also provide visual information to a user via that same display screen.

Processor 502 of device 500 may control the operation of many functions and other circuitry provided by device 500. For example, processor 502 may receive input signals from input component 510 and/or drive output signals to display assembly 512. Processor 502 may load a user interface program (e.g., a program stored in memory 504 or another device or server) to determine how instructions or data received via an input component 510 may manipulate the way in which information is provided to the user via an output component (e.g., display 512). For example, processor 502 may control the viewing angle of the visible information presented to the user by display 512 or may otherwise instruct display 512 to alter the viewing angle.

Microphones 514 can include any suitable number of microphones integrated within device 500. The number of microphones can be three or more. Microphone condition detection module 516 can include any combination of hardware or software components, such as those discussed above in connection with FIGS. 1-4, to determine the state of each of microphones 514.

Electronic device 500 may also be provided with a housing 501 that may at least partially enclose one or more of the components of device 500 for protecting them from debris and other degrading forces external to device 500. In some embodiments, one or more of the components may be provided within its own housing (e.g., input component 510 may be an independent keyboard or mouse within its own housing that may wirelessly or through a wire communicate with processor 502, which may be provided within its own housing).

The described embodiments are presented for the purpose of illustration and not of limitation.

What is claimed is:

1. A method for determining the operating condition of microphones of an electronic device, the method comprising:

receiving signals from a plurality of microphones;

receiving device centric data;

setting a threshold for each of the plurality of microphones based on the device centric data;

identifying as a different signal a received signal that differs from the other of the received signals;

determining a difference factor between the different signal and the other of the received signals; and ceasing to use the different signal when the difference factor exceeds the threshold for a microphone of the plurality of microphones that is a source of the different signal.

2. The method of claim 1 further comprising using the different signal when the difference factor does not exceed the threshold for the microphone that is the source of the different signal.

3. The method of claim 1, wherein the device centric data comprises orientation data of the device.

4. The method of claim 1, wherein the device centric data comprises at least one of ambient light data and proximity data.

5. The method of claim 1, wherein the operating condition comprises one of a free-field and an interference state.

6. A non-transitory machine readable medium storing executable instructions which when executed by a data processing system cause the data processing system to perform a method for determining the operating condition of microphones of an electronic device, the method comprising:

receiving signals from a plurality of microphones;

receiving device centric data;

setting a threshold for each of the plurality of microphones based on the device centric data;

identifying as a different signal a received signal that differs from the other of the received signals;

determining a difference factor between the different signal and the other of the received signals; and ceasing to use the different signal when the difference factor exceeds the threshold for a microphone of the plurality of microphones that is a source of the different signal.

7. The medium of claim 6 further comprising using the different signal when the difference factor does not exceed the threshold for the microphone that is the source of the different signal.

8. The medium of claim 6, wherein the device centric data comprises orientation data of the device.

9. The medium of claim 6, wherein the device centric data comprises at least one of ambient light data and proximity data.

10. The medium of claim 6, wherein the operating condition comprises one of a free-field and an interference state.

11. The medium of claim 10 wherein the plurality of microphones comprise three or more microphones located on different planes of the electronic device.

12. An electronic device comprising:

a plurality of microphones configured to produce signals;

a sensor configured to provide one or more outputs representing device centric data;

a memory for storing a threshold for each of the plurality of microphones based on the device centric data;

a processing system coupled to the memory, to the sensor and to the plurality of microphones to receive the signals produced by the microphones, the processing system configured to identify as a different signal a signal from one of the plurality of microphones that differs from the other signals received from the plurality of microphones, the processing system configured to determine a difference between the different signal and the other signals, the processing system configured to cease using the different signal when the difference exceeds a threshold.

13. The device of claim 12 wherein the plurality of microphones comprise two or more microphones located on different planes of the electronic device.

14. The device of claim 12 wherein the processing system is configured to use the different signal when the difference does not exceed the threshold.

15. The device of claim 12 wherein the device centric data comprises orientation data of the device.

16. The device of claim 12 wherein the device centric data comprises at least one of ambient light data and proximity data.

17. The device of claim 12 wherein the processing system is configured to determine an operating condition of the plurality of microphones.

18. The device of claim 17 wherein the operating condition comprises one of free-field and interference state.

* * * * *